US005106317A

United States Patent [19]

Taylor

[11] Patent Number: 5,106,317

[45] Date of Patent: Apr. 21, 1992

[54] AC ADAPTOR PLUG

[75] Inventor: Jack M. Taylor, Oakville, Canada

[73] Assignee: Austin House, Inc., Ontario, Canada

[21] Appl. No.: 634,726

[22] Filed: Dec. 27, 1990

[30] Foreign Application Priority Data

Dec. 12, 1990 [CA] Canada ..... 2032088

[51] Int. Cl.[5] ..... H01R 29/00

[52] U.S. Cl. ..... 439/173; 439/682

[58] Field of Search ..... 439/171, 173, 174, 176, 439/177, 418, 592, 864, 688, 682, 686, 175, 170, 166

[56] References Cited

U.S. PATENT DOCUMENTS

| | | | |
|---|---|---|---|
| 1,249,247 | 12/1917 | Thomas . | |
| 1,530,011 | 3/1925 | Pacent | 439/173 |
| 2,408,583 | 10/1946 | Sions | 439/592 |
| 2,584,476 | 3/1952 | Liaci | 439/418 |
| 2,810,894 | 10/1957 | Kerr | 439/418 |
| 3,061,811 | 10/1962 | Damon | 439/682 |
| 4,815,983 | 3/1989 | Erickson et al. | 439/175 |
| 4,856,999 | 8/1989 | Flohr | 439/52 |
| 4,911,649 | 3/1990 | Helmich, Jr. | 439/170 |

FOREIGN PATENT DOCUMENTS

| | | |
|---|---|---|
| 628684 | 10/1961 | Canada . |
| 660492 | 4/1963 | Canada . |

*Primary Examiner*—Larry I. Schwartz
*Assistant Examiner*—Hien D. Vu
*Attorney, Agent, or Firm*—Sixbey, Friedman, Leedom & Ferguson

[57] ABSTRACT

An AC adapter plug to be releasably insertable in electrical wall outlets and which has pins which are convertible to fit into different types of electrical wall outlets as may be found, for example, in different countries. The pins are pivotable about their longitudinal axes within sockets in the plug body, into the desired orientations.

11 Claims, 1 Drawing Sheet

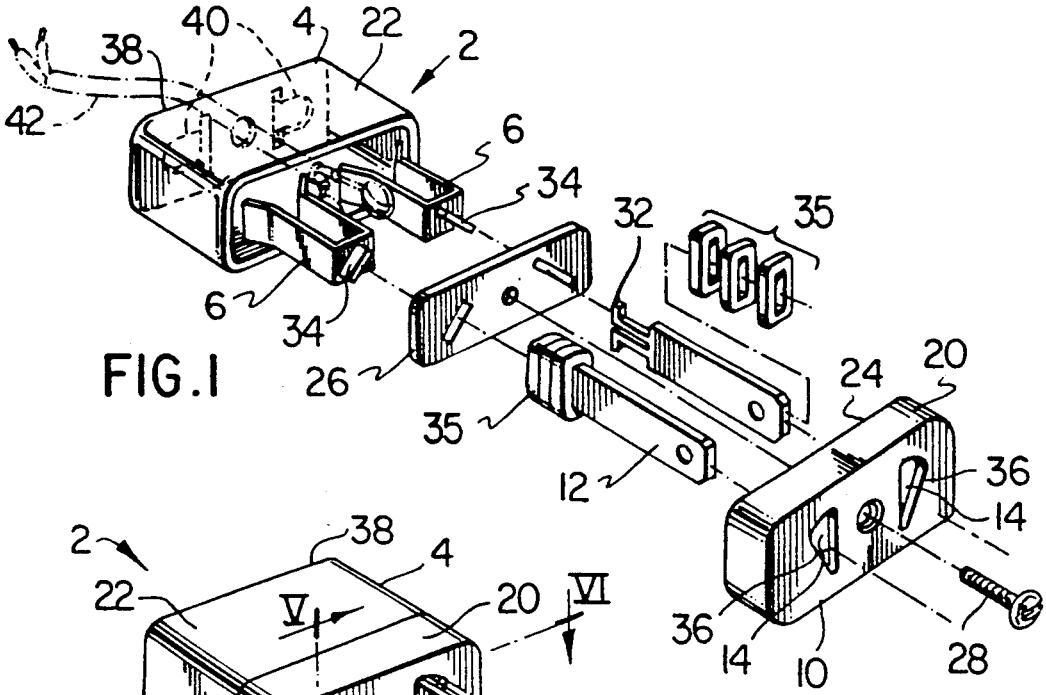
FIG.1
FIG.2
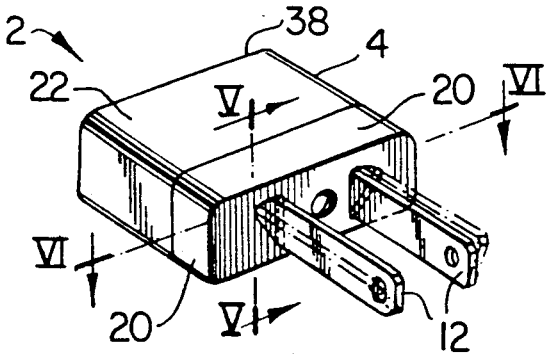
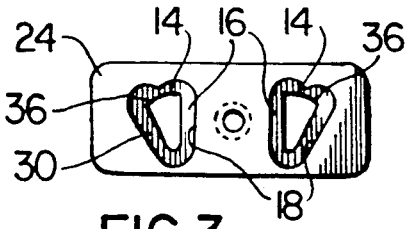
FIG.3
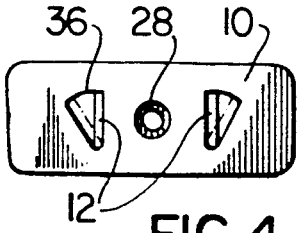
FIG.4
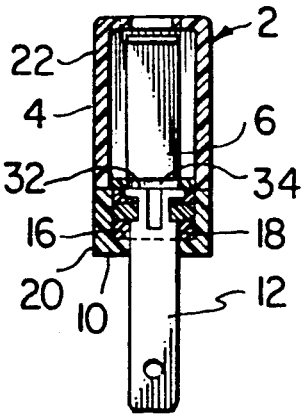
FIG.5
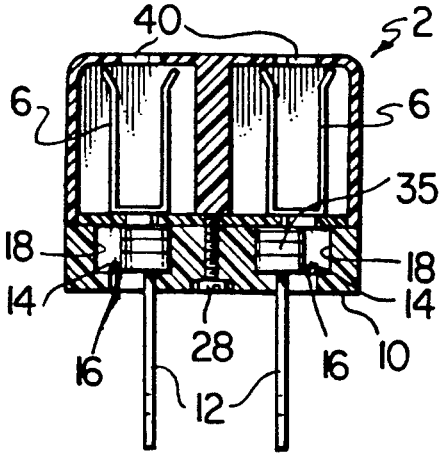
FIG.6

AC ADAPTOR PLUG

BACKGROUND OF THE INVENTION

The present invention relates to an AC adapter plug to be releasably insertable in electrical wall outlets, and more particularly to such an adapter plug which has pins which are convertible to fit into different types of electrical wall outlets as may be found, for example, in different countries.

AC plugs to which the present invention is directed, comprise an electrically insulative body within which are secured separate conductive terminals to which AC wires are connected. The plug has spaced, electrically conductive, flat, elongated pins which are in permanent electric contact with the terminals within the plug. These pins extend outwardly at a 90° angle from a flat base of the plug, the pins being releasably insertable into correspondingly aligned sockets of electrical wall outlets.

One problem experienced frequently by travellers from one country to the other is that the sockets of the electrical wall outlets for such flat pin plugs may be differently aligned from country to country. For example, in North America, the flat pins extend outwardly from the plug base with flat surfaces facing each other and lying in parallel planes. In countries such as Australia, while the pins are essentially spaced a similar distance from each other, they are angled with respect to each other so that their planes intersect at about a 60° angle.

This means that appliances made for North America, if used by a traveller in Australia, require an adapter plug having one surface with sockets to receive the parallel, North American pins, and the opposite surface having extending therefrom the angled, Australian-type pins. Similarly, electrical appliances made for Australia, if used in North America, must have a different type of adapter having on one surface angled sockets to receive the angled pins of the Australian-type plug and parallel pins extending outwardly from the other surface to go into the sockets of North American wall outlets.

Convertible adapter plug devices intended to simplify these and related problems are known. For example, Flohr U.S. Pat. No. 4,856,999 issued Aug. 15, 1989 describes and illustrates an electric adapter having a body in the form of a straight, five-sided prism, each of the sides of which has a different pin configuration for differing configurations of sockets of electrical wall outlets.

Thomas U.S. Pat. No. 1,249,247 issued Dec. 4, 1917 teach convertible plugs in which the pins are pivotably secured by screw means to the terminals within the plug bodies and rotatable to different configurations.

Aarlaht Canadian Patent No. 628,684 issued Oct. 10, 1961 teaches a convertible plug in which the pins are rotatable about an axis and held in position by a slotted closure plate which must be removed to permit rotation of the pins and replaced to hold the pins in position.

Erickson et al U.S. Pat. No. 4,815,983 issued Mar. 28, 1989 and Hubbell Canadian Patent No. 660,492 issued Apr. 2, 1963 describe and illustrate more complicated constructions of adapter plugs permitting alternative arrangements of pins for different purposes.

Helmich, Jr. U.S. Pat. No. 4,911,649 issued Mar. 27, 1990 is of general background interest being directed to an adaptable wall outlet.

It is an object of the present invention to provide a simple and economical construction of AC adapter plug which will permit conversion of the same plug to either North American or Australian type pin arrangements.

SUMMARY OF THE INVENTION

The present invention relates to an AC adapter plug of the type which comprises an electrically insulative body having a flat base, separate conductive terminal means secured within the body to which AC wires from a power cord are connectable and spaced, electrically conductive, flat elongated plug pins electrically contacting said terminal means extending at a 90° angle from the base of the plug to be releasably insertable into electrical wall outlets. In accordance with the invention the body is provided with sockets extending inwardly from the base. Each socket has a bottom and walls which extend upwardly from the bottom to the base of the plug. Each of the pins are pivotable about a longitudinal axis with respect to the body within one of said sockets. Means are provided to secure portions of the pin in each socket in constant electrical contact with its corresponding terminal, in a selected orientation. A friction means is associated with each pin and its corresponding socket to maintain that pin in that selected orientation.

In a preferred embodiment of the present invention, the sockets are formed with walls to permit the pins to swivel between orientations in which the pins face each other and lie in parallel planes and orientations in which the planes of the pins are each about 30° outwardly oriented with respect to said parallel planes. The friction means comprises electrically insulative resilient sleeves fitted about portions of each of the pins in the sockets.

The adapter plug according to the present invention may have wires directly connected to the terminal means or alternatively may have the terminal means accessed by pin-receiving sockets of appropriate configuration to receive plug prongs for example from a power cord of an appliance.

The device according to the present invention is both simple to construct and easy to operate requiring only manual pivotal adjustment of the prongs to the appropriate parallel or angled orientation for, respectively, North American or Australian-type electrical wall outlet socket configurations.

BRIEF DESCRIPTION OF THE DRAWINGS

These and other objects and advantages of the invention will become apparent upon reading the following detailed description and upon referring to the drawings in which:

FIG. 1 is an exploded perspective view of an adapter plug in accordance with the present invention; and FIG. 2 is a perspective view of the plug of FIG. 1 with its parts assembled;

FIG. 3 is a plan view of the bottom of the upper portion of the adapter of FIG. 1;

FIG. 4 is a plan view of the base of the lower portion of the adapter of FIG. 1; and FIGS. 5 and 6 are section views along lines IV—IV and V—V respectively of FIG. 2.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to the drawings there is shown in FIGS. 1 and 2 an AC adapter plug 2 in accordance with the present invention comprising an electrically insulative body 4 and separate conductive terminal means 6 within the body to which AC wires either directly from a power cord or from the pins of another plug are connectable. Extending from flat base 10 at the bottom of plug 2 are a pair of spaced electrically conductive, flat elongated plug pins 12, these pins arranged, as can be seen in FIGS. 5 and 6, so as to contact at all times terminal means 6.

Pins 12 extend at all times from base 10 at a 90° orientation thereto.

As can be seen in FIGS. 1 and 3, body 4 is provided with a pair of sockets 14 having a bottom 16 (FIG. 6) and walls 18 upwardly extending from that bottom to the base 10 of the plug. In the illustrated embodiment, body 4 is formed of an upper portion 20, in which sockets 14 are formed, and a lower portion 22 in which the terminal means 6 are positioned. Upper portion 20 and lower portion 22 are secured together by means of a screw 28 passing through upper portion 20 into lower portion 22, so that flat mating surface 24 of upper portion 20 and flat mating surface of lower portion 22 are in abutting relationship (FIGS. 5 and 6). Surface 26 of lower portion 22 then forms the bottom 16 of socket 14. At the top of each socket 14, at base 10, a ledge or constriction 30 is provided, the function of which will be explained in more detail hereinafter.

Each of the pins 12 is secured in a corresponding socket 14 so as to be pivotable about a longitudinal axis with respect to body 4 while the base 32 of each pin is held in constant contact with an exposed surface 34 of terminal means 6. Each exposed surface 34 is co-planar with or slightly above the surface of base 26 in lower body portion 22. As can be seen in FIG. 5, base 32 of each pin 12 extends outwardly beyond the rest of the pin, to provide a larger contact surface for that pin 12 on exposed surface 34 of terminal means 6 and to assist in retaining sleeve 35 on pin 12.

Sleeve 35 is preferably made from an electrically insulative material and extends within each socket 14 along the length of each pin 12 between pin base 32 and the ledge 30. Sleeve 35 provides an obstruction against ledge 30 to hold each pin firmly in position within socket 14. As well sleeve 35 ensures through frictional engagement with the walls 18 of its socket 14, that when its pin has been properly oriented within that socket, that orientation is maintained until manually altered again. In this manner, and because of the configuration of the walls of socket 14 and the opening 36 through ledge 30 in the upper portion 20 of body 2, each pin 12 may be swivelled between relative orientations in which the two pins lie in parallel planes with flat surfaces facing each other (FIGS. 2 and 4, full line) and orientations in which the planes of the pins are each about 30° outwardly oriented with respect to those parallel planes (FIGS. 2 and 4, chain line), the former orientation for North American-type electrical wall outlet sockets and the latter for Australian-type. The insulative sleeve 35 is preferably formed from material such as rubber or an appropriate plastic which will frictionally engage with the walls 18, bottom 16 and ledge 30 to hold the pin in socket 14 in a desired orientation about its axis. As well, as can be seen in FIGS. 4 and 5, the sleeve may be made of a series of smaller adjacent sleeves of the same or different materials selected to provide the most advantageous characteristics of stability, frictional engagement within socket 14, etcetera.

In the illustrated preferred embodiment, a pair of parallel, pin-receiving sockets 40 are formed in the end 38 of body 2 opposite from base 10 to communicate with terminal means 6 and receive either the flat or round pins of an appropriate plug so that the pins electrically contact terminal means 6. Of course adapter plug 2 instead of being provided with sockets 40, may have a power cord 42 (chain line) feeding directly into it with the wires of the power cord secured to terminal means 6 by appropriate securing means.

In operation, as has been previously described, depending on the orientation of the sockets of the electrical wall outlet into which it is desired to insert pins 12, those pins may be simply manually pivoted into appropriate corresponding orientation (parallel or 60° angles with respect to each other), and the adapter plug is ready for use.

Thus it is apparent that there has been provided in accordance with the invention an improved AC adapter plug that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In an AC adapter plug comprising an electrically insulative body having a flat base, separate conductive terminal means secured within the body to which AC wires from a power cord are connectable and spaced, electrically conductive, flat elongated plug pins electrically contacting said terminal means and extending at a 90° angle from the base of the plug to be releasably insertable into electrical wall outlets, the improvement characterized in that the body is provided with sockets extending inwardly from the base, each socket having a bottom and walls upwardly extending from the bottom to the base of the plug, each of the pins being pivotable about a longitudinal axis thereof within one of said sockets, means to secure portions of the pin in the sockets in constant electrical contact with its corresponding terminal in a selected orientation and friction means associated with each pin and its corresponding socket to maintain said pin in that selected orientation.

2. A plug according to claim 1, for use with domestic electrical appliances, the plug having a pair of said pins.

3. A plug according to claim 1, the body being provided with pin-receiving sockets of appropriate shape and position leading to the terminal means.

4. A plug according to claim 1, the body and terminal means formed to receive wires from an electrical power cord.

5. A plug according to claim 1 wherein said sockets are formed with walls to permit said pins to swivel between orientations in which the pins face each other and lie in parallel planes and orientations in which the planes of the pins are each about 30° outwardly oriented with respect to said parallel planes.

6. A plug according to claim 5 wherein said friction means comprise electrically insulative resilient sleeve means fitted about portions of each of the pins in said sockets.

7. A plug according to claim 6 wherein the portions of the pins in electrical contact with the terminal means extend outwardly with respect to the rest of said pins and the sleeve means are supported in position on said outwardly extending portions of the pins.

8. A plug according to claim 7 wherein the portions of the walls of the sockets at the base of the body are constricted so as to limit appropriately the pivotal movement of the pins and prevent withdrawal of the pins and sleeves when in position in the sockets.

9. A plug according to claim 8 wherein said body is formed of upper and lower portions releasably securable to each other along flat, confronting surfaces by securing means, the walls of the sockets being formed in said upper portion, the terminal means positioned in the lower portion and having flat surfaces co-planar with or slightly above said flat surface of the lower portion, and said outwardly extending portions of the pins being slidable with respect to, and in electrical contact with, said flat surfaces of the terminal means.

10. A plug according to claim 9, for use with domestic electrical appliances, the plug having a pair of said pins.

11. In an AC adapter plug comprising an electrically insulative body having a flat base, separate conductive terminal means secured within the body to which AC wires from a power cord are connectable and spaced, electrically conductive, flat elongated plug pins electrically contacting said terminal means and extending at a 90° angle from the base of the plug to be releasably insertable into electrical wall outlets, the improvement characterized in that the body is provided with sockets extending inwardly from the base, each socket having a bottom and walls upwardly extending from the bottom to the base of the plug, each of the pins being pivotable about a longitudinal axis thereof within one of said sockets, means to secure portions of the pin in the sockets in constant electrical contact with its corresponding terminal in a selected orientation and friction means associated with each pin and its corresponding socket to maintain said pin in that selected orientation, wherein said friction means comprise electrically insulative resilient sleeve means fitted about portions of each of the pins in said sockets.

* * * * *